US010253968B2

(12) United States Patent
Cheng et al.

(10) Patent No.: US 10,253,968 B2
(45) Date of Patent: Apr. 9, 2019

(54) PUSH-BUTTON SWITCH OPERATING PORTION WITH DIVERGING AND CONVERGING LENS

(71) Applicant: Siemens Aktiengesellschaft, München (DE)

(72) Inventors: Zhi Cheng, Suzhou (CN); Jian Ming Liu, Suzhou (CN); Song Liu, Jiang Su (CN); Radek Melich, Lisny (CZ); Hua Lang Wang, Suzhou (CN); Hong Yang, Suzhou (CN); Shi Bo Yin, Suzhou (CN)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 160 days.

(21) Appl. No.: 14/899,145

(22) PCT Filed: Aug. 30, 2013

(86) PCT No.: PCT/CN2013/082735
§ 371 (c)(1),
(2) Date: Dec. 17, 2015

(87) PCT Pub. No.: WO2015/027490
PCT Pub. Date: Mar. 5, 2015

(65) Prior Publication Data
US 2016/0161105 A1 Jun. 9, 2016

(51) Int. Cl.
*H01H 9/16* (2006.01)
*G05G 1/02* (2006.01)
(Continued)

(52) U.S. Cl.
CPC ..... *F21V 33/00* (2013.01); *F21V 5/008* (2013.01); *F21V 5/048* (2013.01); *F21V 17/164* (2013.01);
(Continued)

(58) Field of Classification Search
CPC ..... G05G 1/02; H01H 9/161; H01H 9/162; H01H 9/164; H01H 13/023; H01H 13/026
See application file for complete search history.

(56) References Cited

U.S. PATENT DOCUMENTS 1,628,209 A * 5/1927 Wilcox ..... G05G 1/02 116/202
2,234,954 A * 3/1941 Bergman ..... H01H 13/023 200/314
(Continued)

FOREIGN PATENT DOCUMENTS

CN 1416583 A 5/2003
CN 1950032 A 4/2007
(Continued)

OTHER PUBLICATIONS

International Search Report PCT/ISA/210 for International Application No. PCT/CN2013/082735 dated Apr. 30, 2014.
Extended European Search Report dated Feb. 28, 2017.

*Primary Examiner* — Ismael Negron
(74) *Attorney, Agent, or Firm* — Harness, Dickey & Pierce, P.L.C.

(57) ABSTRACT

An operating button includes a light source, a push rod with a diverging lens, and an operating head with a condensing lens. The optical center of the diverging lens, the optical center of the condensing lens and the light source are in the same line such that light rays generated by the light source
(Continued)

pass through the diverging lens and the converging lens before exiting the operating head as parallel light.

5 Claims, 3 Drawing Sheets

(51) Int. Cl.

| | |
|---|---|
| ***F21V 33/00*** | (2006.01) |
| ***F21V 5/00*** | (2018.01) |
| ***F21V 5/04*** | (2006.01) |
| ***F21V 17/16*** | (2006.01) |
| ***H01H 13/02*** | (2006.01) |
| *F21Y 115/10* | (2016.01) |

(52) U.S. Cl.
CPC ..... *H01H 13/023* (2013.01); *F21Y 2115/10* (2016.08); *H01H 2219/066* (2013.01)

(56) References Cited

U.S. PATENT DOCUMENTS

| | | | | | |
|---|---|---|---|---|---|
| 2,273,353 | A | * | 2/1942 | Harris | H01H 13/023 200/314 |
| 2,816,995 | A | * | 12/1957 | Harrington | H01H 13/023 200/314 |
| 2,996,702 | A | * | 8/1961 | Jentges | H01H 13/023 200/318.2 |
| 3,387,693 | A | * | 6/1968 | Wirth | B41J 5/08 200/308 |
| 3,753,179 | A | * | 8/1973 | Straub | H01H 13/023 335/206 |
| 3,805,007 | A | * | 4/1974 | Leff | H01H 9/162 200/314 |
| 4,161,637 | A | * | 7/1979 | Priesemuth | H01H 13/562 200/314 |
| 4,404,445 | A | * | 9/1983 | Baran | H01H 3/022 200/314 |
| 4,758,701 | A | * | 7/1988 | Nagel | H01H 13/023 200/311 |
| 5,534,840 | A | * | 7/1996 | Cuingnet | H01H 9/02 200/314 |
| 7,369,331 | B2 | | 5/2008 | Sachdev et al. | |
| 7,855,844 | B2 | | 12/2010 | Okabe | |
| 2007/0265545 | A1 | | 11/2007 | Sachdev et al. | |
| 2008/0285158 | A1 | | 11/2008 | Okabe | |
| 2011/0282247 | A1 | | 11/2011 | Denise et al. | |
| 2012/0160642 | A1 | * | 6/2012 | Liao | H01H 13/023 200/310 |

FOREIGN PATENT DOCUMENTS

| | | | |
|---|---|---|---|
| CN | 101028175 | A | 9/2007 |
| CN | 101308243 | A | 11/2008 |
| CN | 202747002 | U | 2/2013 |
| CN | 103037775 | A | 4/2013 |
| CN | 203454076 | U | 2/2014 |
| EP | 1049120 | A2 | 11/2000 |
| GB | 2310084 | A | 8/1997 |
| JP | 07289426 | | 7/1995 |
| JP | H11224563 | A | 8/1999 |
| JP | 2008047370 | A | 2/2008 |

* cited by examiner

PUSH-BUTTON SWITCH OPERATING PORTION WITH DIVERGING AND CONVERGING LENS

PRIORITY STATEMENT

This application is the national phase under 35 U.S.C. § 371 of PCT International Application No. PCT/CN2013/082735 which has an International filing date of Aug. 30, 2013, which designated the United States of America, the entire contents of which are hereby incorporated herein by reference.

FIELD

The present invention generally relates to an operating button, especially to an operating button with a light source.

BACKGROUND

An operating button can output light rays to the outside of the operating button via a light source provided therein, so as to identify the state of the operating button or a device. Because of the limitation of the volume and structure of the operating button, when in operation, the output light rays of the operating button have a long light path such that the brightness of the output light rays is insufficient. In addition, the light rays output by the operating button are not in parallel such that the light rays irradiated thereby are not even and have light spots.

SUMMARY

An embodiment of the present invention provides an operating button for improving the brightness of the light rays output by the operating button.

An embodiment of the present invention provides an operating button, comprising a light source, a push rod and an operating head. The light source can output light rays. The push rod is provided with a diverging lens and the operating head is provided with a condensing lens. The optical center of the diverging lens, the optical center of the condensing lens and the light source are in the same line, so that the light rays generated by the light source can pass through the push rod and the operating head to be irradiated out.

BRIEF DESCRIPTION OF DRAWINGS

The following accompanying drawings are merely for illustrative description and explanation of the present invention and are not intended to limit the scope of the present invention.

DETAILED DESCRIPTION OF EXAMPLE EMBODIMENTS

Figure 1:
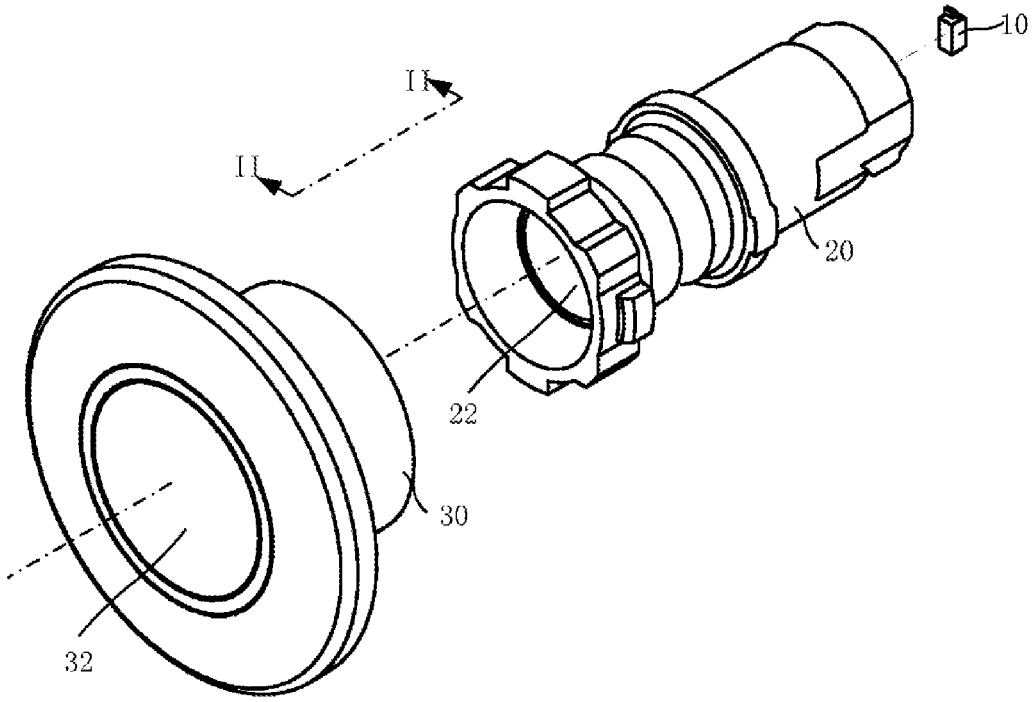
FIG. 1 is a structural schematic diagram used for illustrating an illustrative embodiment of an operating button.

An embodiment of the present invention provides an operating button, comprising a light source, a push rod and an operating head. The light source can output light rays.

The push rod is provided with a diverging lens and the operating head is provided with a condensing lens. The optical center of the diverging lens, the optical center of the condensing lens and the light source are in the same line, so that the light rays generated by the light source can pass through the push rod and the operating head to be irradiated out.

In the operating button, there is only one diverging lens and one condensing lens in the direction of propagation of the light rays generated by the light source, and therefore the distance between the light source and the diverging lens can be conveniently adjusted and the brightness of the light rays irradiated by the operating button is improved.

In another illustrative embodiment of the operating button, the push rod and the diverging lens are integrally formed and the operating head and the condensing lens are integrally formed.

In a further illustrative embodiment of the operating button, the light source is a light-emitting diode (LED).

In a yet further illustrative embodiment of the operating button, the operating button has an installation direction for connecting the push rod with the operating head. The operating head is provided with a connecting end which has a guiding part and a locking part. The push rod is provided with a locking end which has an inserting part and a snapping part, the inserting part is movable along the guiding part in the installation direction, and the snapping part is connectable to the locking part.

In a yet further illustrative embodiment of the operating button, the guiding part is a groove and the inserting part is a protrusion.

In a yet further illustrative embodiment of the operating button, the locking part has a guiding surface and a slot, the snapping part has an inserting surface and a snap-fitting surface, and the inserting surface is movable along the guiding surface in the installation direction such that the snap-fitting surface is snap-fitted with the slot.

For the sake of better understanding of the technical features, objects and effects of the present invention, particular embodiments of the present invention will now be described in detail with reference to the accompanying drawings, in which the same reference numeral refers to the same part.

The term "illustrative" herein means "serving as an example, instance or description", and any "illustrative" illustration and embodiment described herein should not be interpreted as a more preferred or a more advantageous technical solution.

For the simplicity of the figures, only parts related to the present invention are illustratively shown in each figure, and they do not represent the actual structure thereof as a product. Moreover, in order to make the drawings simple and easy to understand, in some figures, only one of components with the same structure or function is schematically depicted or marked.

FIG. 1 is a structural schematic diagram used for illustrating an illustrative embodiment of an operating button.

Figure 2:
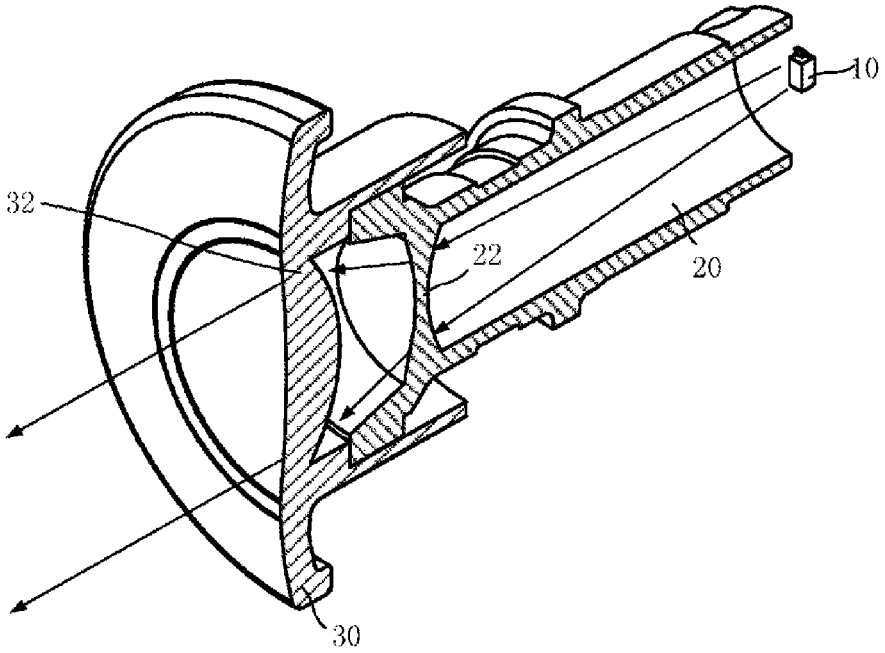
FIG. 2 is a sectional view along the line II-II in FIG. 1.

FIG. 2 is a sectional view along the line II-II in FIG. 1 and shows the assembled operating button. Referring to FIGS. 1 and 2, the operating button comprises a light source 10, a push rod 20 and an operating head 30.

The light source 10 can output light rays. The light rays output by the light source 10 pass through the push rod 20 and the operating head 30 successively and are irradiated from the operating head 30. In one illustrative embodiment of the operating button, the light source 10 is a light-emitting diode (LED) and it is certain that other light sources can also be used according to requirements.

The push rod 20 is of a hollow structure such that the light rays emitted from the light source 10 can pass through the push rod 20. The push rod 20 has a diverging lens 22, and the light rays emitted from the light source 10 pass through the diverging lens 22 when propagating in the push rod. In one illustrative embodiment of the operating button, the diverging lens 22 is a concave lens.

The operating head 30 has a condensing lens 32, and the light rays passed through the diverging lens 22 illuminate towards the outside of the operating button after passing through the condensing lens 32. In one illustrative embodiment of the operating button, the condensing lens 32 is a convex lens.

In the direction of propagation of the light rays emitted from the light source 10, the optical center of the diverging lens 22, the optical center of the condensing lens 32 and the light source 10 are in the same line. In this case, the optical center of the diverging lens 22, the optical center of the condensing lens 32 and the light source 10 are in the same line. The light rays emitted from the light source 10 (as shown by arrows in FIG. 2) are diverged by the concave lens, and then pass through the convex lens to become parallel light, such that the illumination light rays of the operating button is even and the generation of light spots is avoided. There is only one diverging lens and one condensing lens in the direction of propagation of the light rays emitted from the light source 10, and therefore the distance between the light source and the diverging lens can be shortened by using a simple optical structure and the brightness of the light rays irradiated by the operating button is improved.

In the above-mentioned operating button, the size of the outer diameters of the diverging lens and the condensing lens are respectively determined by the diameter of the push rod and the diameter of the operating head. In addition, the operating button can output parallel light beams by adjusting the distance between the LED and the diverging lens, the distance between the diverging lens and the condensing lens, the focal distance of the diverging lens and the focal distance of the condensing lens, thereby eliminating light spots and obtaining a sufficient light brightness. Any method in the art can be used to adjust the parameters such as the distance between the LED light source and the diverging lens, the distance between the diverging lens and the condensing lens, the focal distance of the diverging lens and the focal distance of the condensing lens. With regard to a specific operating button (mainly refers to the length and diameter thereof), a person skilled in the art could adjust the above-mentioned parameters by means of common optical knowledge to obtain desired values of these parameters to enable the operating button to output parallel light beams and obtain a sufficient light ray brightness, and the specific parameter adjusting process and method will not be described unnecessarily herein.

In one illustrative embodiment of the operating button, the condensing lens and the operating head are integrally formed, for example, the two may be plastic components and are integrally formed by means of an injection molding process. The diverging lens and the push rod may also be integrally formed, for example formed by plastic injection-molding.

Using an integral forming process to process the condensing lens and the operating head, and the diverging lens and the push rod 20, can simplify the whole assembling procedure of the operating button and prevent the changes in the relative positions of the condensing lens and the operating head, and the diverging lens and the push rod caused by processing errors. In addition, the operating head and the condensing lens may also be separated components rather than being integrally formed, for example, the condensing lens can be arranged between the push rod and the operating head and the push rod, and are clamped directly by the push rod and the operating head 30.

Figure 3:
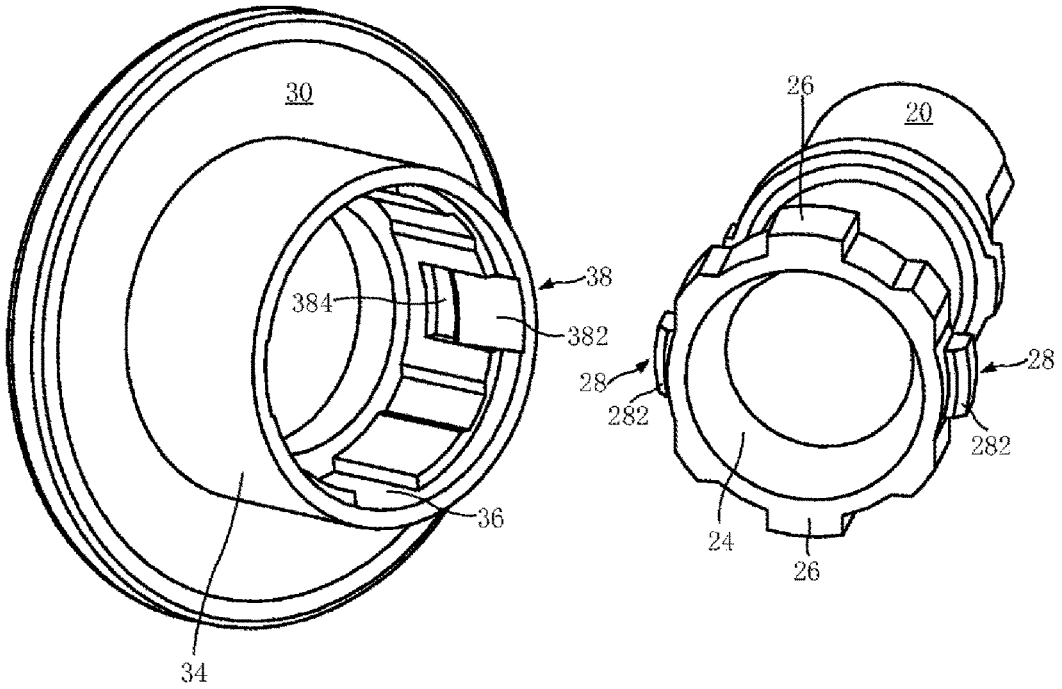
FIG. 3 is used for illustrating the connecting structure of a push rod and an operating head.

FIG. 3 is used for illustrating the connecting structure of the push rod and the operating head. As shown in this figure, the operating head 30 is provided with a connecting end connected to the push rod 20, and the push rod 20 is provided with a locking end 24 connected to the operating head 30. Two guiding parts 36 and two locking parts 38 are provided on the connecting end 34. Two inserting parts 26 and two snapping parts 28 are provided on the locking end 24.

Figure 4:
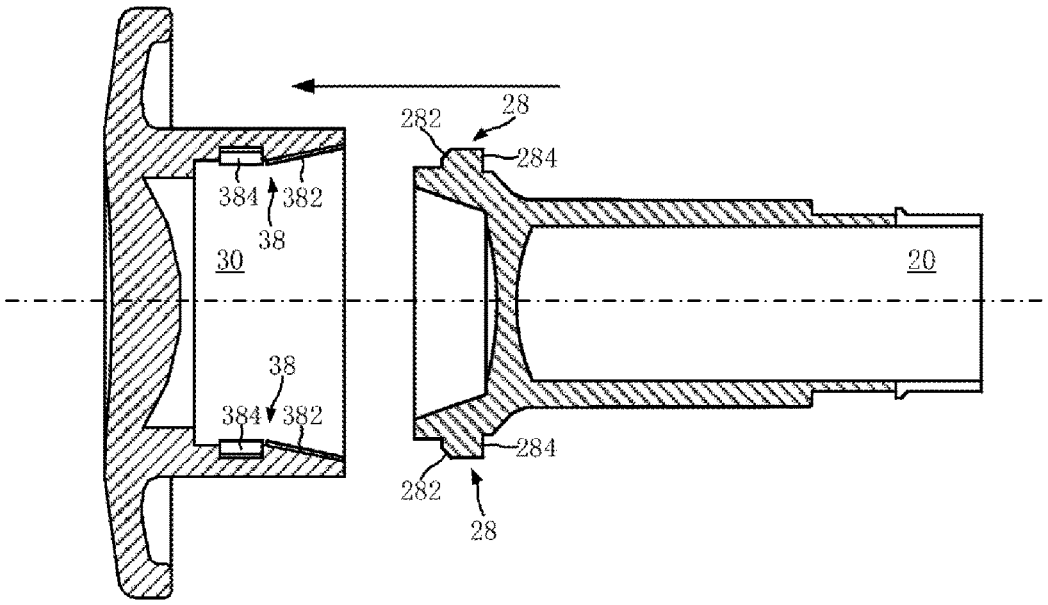
FIGS. 4-6 are used for illustrating the process of connecting a locking part with a snapping part.

Referring to FIGS. 3 and 4, in the process of connecting the push rod 20 to the operating head 30, the inserting parts 26 can enter the guiding parts 36 and move along the guiding parts 36 such that in the installation direction as shown by an arrow in the figure, the locking parts 38 and the snapping parts 28 are aligned and the connection between the locking parts 38 and the snapping parts 28 is finally completed, and therefore the connection between the push rod 20 and the operating head 30 is realized. In one illustrative embodiment of the operating button, the guiding part 36 is a groove arranged on the connecting end 34, and the groove extends in the installation direction as shown by an arrow in FIG. 4. The inserting part 26 is a protrusion arranged on the locking end 24, and the protrusion extends in the installation direction as shown by the arrow in FIG. 4. The protrusion of the inserting part 26 can be inserted into the groove of the guiding part 36 such that the relative movement between the push rod 20 and the operating head 30 can only be in the installation direction as shown by the arrow in the figure.

Referring to FIGS. 3 and 4, in one illustrative embodiment of the operating button, the locking part 38 has a guiding surface 382 and a slot 384. The snapping part 28 has an inserting surface 282 and a snap-fitting surface 284. When the push rod 20 moves relative to the operating head 30 in the installation direction as shown by the arrow in the figure, the inserting surface 282 can move along the guiding surface 382 such that the snap-fitting surface 284 can be snap-fitted in the slot 384, and therefore the fixed connection of the push rod 20 and the operating head 30 is completed.

Figure 5:
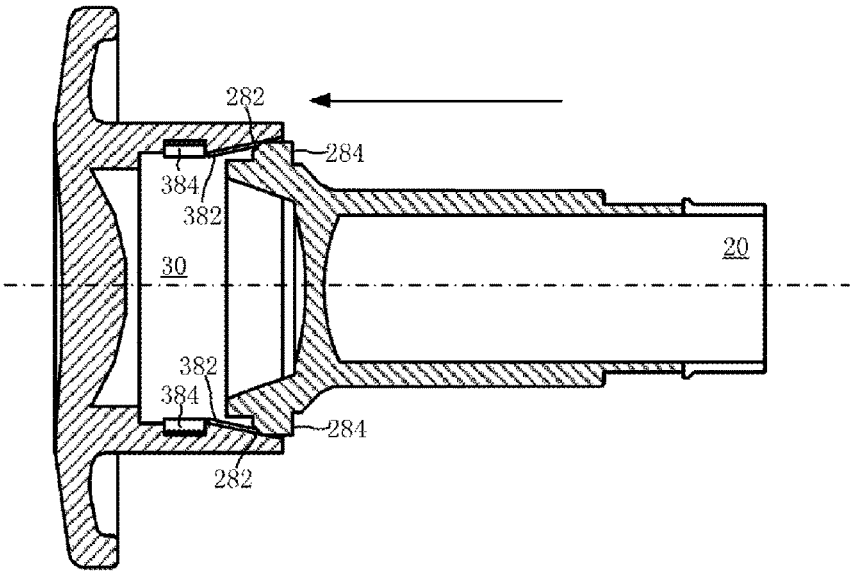
Figure 6:
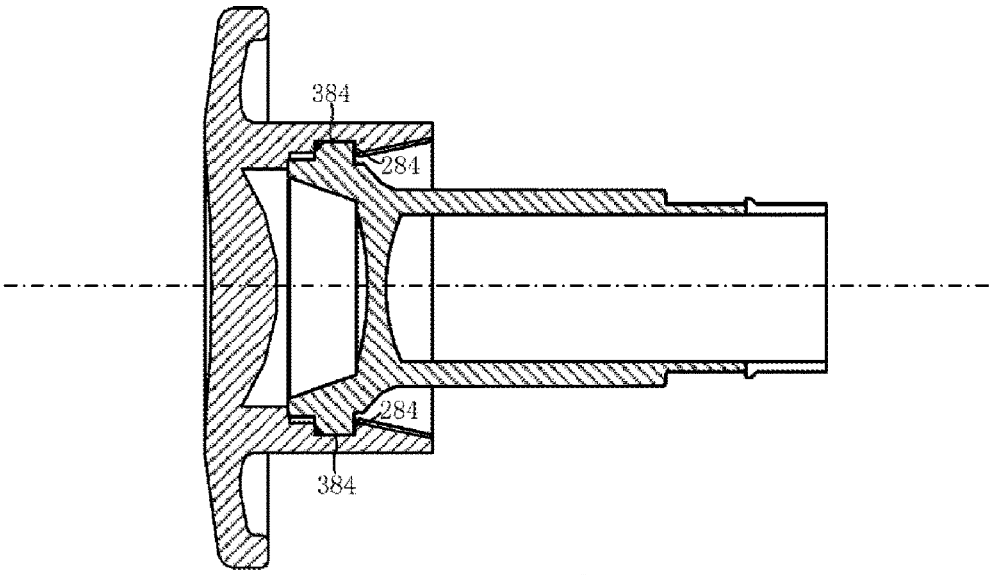

FIGS. 4-6 are used for illustrating the process of connecting a locking part with a snapping part. As shown in FIG. 4, in this case, the push rod 20 and the operating head 30 are separated, and the push rod 20 and the operating head 30 start to be assembled and connected with each other in the installation direction as shown by the arrow in the figure.

As shown in FIG. 5, in this case, the inserting surface 282 of the snapping part 28 starts to make contact with the guiding surface 382 of the locking part 38. The inserting surface 282 moves along the guiding surface 382 such that the guiding surface 382 and the inserting surface 282 are compressed relative to each other, and in turn the deformation of the locking end 24 and the connecting end 34 takes place.

The push rod 20 and the operating head 30 continue moving relative to each other in the installation direction as shown by the arrow in the figure, and as shown in FIG. 6, in this case, the snap-fitting surface 284 is snap-fitted in the slot 384 such that the operating head 30 is fixedly connected to the push rod 20, and the operating head 30 and the push rod cannot be separated from each other, which provides operating safety to the operating button.

It should be understood that, although the description is given according to each of the embodiments, but each embodiment does not only comprise an independent technical solution, this narration manner of the description is only for clarity, and for a person skilled in the art, the description shall be regarded as a whole, and the technical solution in each of the embodiments can also be properly combined to form other implementations that can be understood by a person skilled in the art.

The series of detailed descriptions set forth above is merely directed to specific descriptions of feasible embodiments of the present invention. The series of detailed descriptions are not intended to limit the scope of protection of the present invention, and any equivalent embodiment or alteration of the present invention, such as a combination of features, a segmentation or duplication, made without departing from the technical spirit of the present invention, shall be included within the scope of protection of the present invention.

DESCRIPTION OF REFERENCE NUMERALS

10 Light source
20 Push rod
22 Diverging lens
24 Locking end
26 Inserting part
28 Snapping part
282 Inserting surface
284 Snap-fitting surface
30 Operating head
32 Condensing lens
34 Connecting end
36 Guiding part
38 Locking part
382 Guiding surface
384 Slot

The invention claimed is:

1. An operating button, comprising:

a light source;

a push rod including a diverging lens; and an operating head including a condensing lens, wherein the push rod and the operating head are arranged in a direction of propagation of light rays output from the light source, and an optical center of the diverging lens, an optical center of the condensing lens and said light source are in a same line such that parallel light is output by the condensing lens, wherein said operating button includes an installation direction for connecting said push rod with said operating head, said operating head is provided with a connecting end including a plurality of guiding parts and a plurality of locking parts arranged thereon, said push rod is provided with a locking end including a plurality of inserting parts and a plurality of snapping parts arranged thereon, said inserting parts being movable along said guiding parts in said installation direction, and said snapping parts being connectable to said locking parts, each guiding part is a groove and each inserting part is a protrusion, and each locking part includes a guiding surface recessed into the locking part and a slot recessed into the guiding surface, each snapping part includes an inserting surface and a snap-fitting surface, and said inserting surface is movable along said guiding surface in said installation direction such that said snap-fitting surface is snap-fitted with said slot.

2. The operating button of claim 1, wherein said light source is a light-emitting diode.

3. The operating button of claim 1, wherein the inserting surface is tilted relative to the same line, and wherein each of the optical center of the diverging lens, the optical center of the condensing lens and the optical center of the light source are in the same line.

4. The operating button of claim 1, wherein said push rod and said diverging lens are integrally formed, and said operating head and said condensing lens are integrally formed.

5. The operating button of claim 4, wherein said light source is a light-emitting diode.

* * * * *